US008512160B2

(12) United States Patent
Gobush

(10) Patent No.: US 8,512,160 B2
(45) **Date of Patent: *Aug. 20, 2013**

(54) MULTISHUTTER CLUB-BALL ANALYZER

(75) Inventor: William Gobush, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 2046 days.

This patent is subject to a terminal disclaimer.

(21) Appl. No.: 10/656,882

(22) Filed: Sep. 8, 2003

(65) Prior Publication Data

US 2005/0054456 A1 Mar. 10, 2005

(51) Int. Cl.
*G06F 17/00* (2006.01)

(52) U.S. Cl.
USPC ..... 473/131; 473/407; 473/190; 473/198; 273/186.1

(58) Field of Classification Search
None
See application file for complete search history.

(56) References Cited

U.S. PATENT DOCUMENTS

| | | | | | |
|---|---|---|---|---|---|
| 4,136,387 | A * | 1/1979 | Sullivan et al. | ..... | 473/200 |
| 4,137,566 | A * | 1/1979 | Haas et al. | ..... | 473/209 |
| 4,158,853 | A * | 6/1979 | Sullivan et al. | ..... | 348/157 |
| 4,375,887 | A * | 3/1983 | Lynch et al. | ..... | 473/409 |
| 4,924,088 | A * | 5/1990 | Carman et al. | ..... | 250/271 |
| 5,331,362 | A * | 7/1994 | DiRisio | ..... | 396/62 |
| 5,342,054 | A * | 8/1994 | Chang et al. | ..... | 473/156 |
| 5,470,072 | A * | 11/1995 | Cunningham | ..... | 473/220 |
| 5,471,383 | A | 11/1995 | Gobush et al. | ..... | 364/410 |
| 5,575,719 | A * | 11/1996 | Gobush et al. | ..... | 473/223 |
| 5,852,672 | A * | 12/1998 | Lu | ..... | 382/154 |
| 6,014,887 | A * | 1/2000 | Naruo et al. | ..... | 73/12.04 |
| 6,032,860 | A * | 3/2000 | Brian | ..... | 235/454 |
| 6,041,651 | A * | 3/2000 | Naruo et al. | ..... | 73/491 |
| 6,086,487 | A * | 7/2000 | Morgan et al. | ..... | 473/407 |
| 6,241,622 | B1 * | 6/2001 | Gobush et al. | ..... | 473/199 |
| 6,285,445 | B1 * | 9/2001 | Winfield et al. | ..... | 356/28 |
| 6,390,934 | B1 | 5/2002 | Winfield et al. | ..... | 473/351 |
| 6,431,990 | B1 | 8/2002 | Manwaring | ..... | 473/199 |
| 6,488,591 | B1 | 12/2002 | Gobush et al. | ..... | 473/199 |
| 6,533,674 | B1 * | 3/2003 | Gobush | ..... | 473/199 |
| 6,565,448 | B2 * | 5/2003 | Cameron et al. | ..... | 473/131 |
| 6,579,190 | B2 * | 6/2003 | Yamamoto | ..... | 473/141 |
| 6,592,465 | B2 * | 7/2003 | Lutz et al. | ..... | 473/198 |
| 6,602,144 | B2 * | 8/2003 | Manwaring et al. | ..... | 473/198 |
| 6,616,543 | B1 * | 9/2003 | Gobush et al. | ..... | 473/199 |
| 6,672,978 | B1 * | 1/2004 | Morgan et al. | ..... | 473/407 |
| 6,758,759 | B2 * | 7/2004 | Gobush et al. | ..... | 473/131 |
| 7,086,954 | B2 * | 8/2006 | Gobush et al. | ..... | 473/198 |
| 7,202,613 | B2 * | 4/2007 | Morgan et al. | ..... | 315/312 |
| 7,291,072 | B2 * | 11/2007 | Bissonnette et al. | ..... | 473/198 |
| 7,477,309 | B2 * | 1/2009 | Cuccias | ..... | 348/342 |

(Continued)

*Primary Examiner* — Paul A D'Agostino
(74) *Attorney, Agent, or Firm* — Smith, Gambrell & Russell, LLP

(57) ABSTRACT

A camera system that measures golf club and golf ball kinematics is disclosed. Preferably, a plurality of retroreflective markers are placed on a golf club and a plurality of fluorescent markers are placed on a golf ball. Using two separate strobe lamps, images of a golf club and golf ball are acquired. The output of each of the strobe lamps is preferably filtered to pass predetermined colors of light. The input to each of the cameras is also preferably filtered. Based on the filtered light outputs generated by each light source and the filtered camera inputs, at least two images of the golf club and the golf ball in motion may be acquired. The acquired images may be used to analyze the kinematics of the golf ball and golf club.

29 Claims, 4 Drawing Sheets

(56) References Cited

U.S. PATENT DOCUMENTS

| | | | | |
|---|---|---|---|---|
| 7,483,049 | B2 * | 1/2009 | Aman et al. | 348/162 |
| 7,662,047 | B2 * | 2/2010 | Ueshima et al. | 473/199 |
| 2001/0023209 | A1 * | 9/2001 | Yamamoto | 473/407 |
| 2001/0026319 | A1 * | 10/2001 | Honey et al. | 348/169 |
| 2002/0030742 | A1 * | 3/2002 | Aman et al. | 348/169 |
| 2002/0101189 | A1 * | 8/2002 | Vo et al. | 315/241 S |
| 2002/0140901 | A1 * | 10/2002 | Reichow et al. | 351/163 |
| 2002/0155896 | A1 * | 10/2002 | Gobush et al. | 473/197 |
| 2002/0173367 | A1 * | 11/2002 | Gobush et al. | 473/197 |
| 2003/0016368 | A1 * | 1/2003 | Aman et al. | 356/615 |
| 2003/0027655 | A1 * | 2/2003 | Lutz et al. | 473/198 |
| 2003/0035301 | A1 * | 2/2003 | Gardiner et al. | 362/583 |
| 2003/0095186 | A1 * | 5/2003 | Aman et al. | 348/162 |
| 2003/0130054 | A1 * | 7/2003 | Bissonnette et al. | 473/199 |
| 2003/0156425 | A1 * | 8/2003 | Turnbull et al. | 362/545 |
| 2004/0032970 | A1 * | 2/2004 | Kiraly | 382/103 |
| 2005/0026710 | A1 * | 2/2005 | Pao | 473/141 |
| 2005/0046739 | A1 * | 3/2005 | Voss et al. | 348/371 |
| 2005/0054456 | A1 * | 3/2005 | Gobush | 473/221 |
| 2006/0008116 | A1 * | 1/2006 | Kiraly et al. | 382/103 |
| 2008/0309801 | A1 * | 12/2008 | Cuccias | 348/242 |

* cited by examiner

MULTISHUTTER CLUB-BALL ANALYZER

FIELD OF THE INVENTION

The present invention relates to a camera system that measures golf club and golf ball kinematics. More specifically, the present invention relates to a camera system that uses a retroreflective lighting system for club kinematics and a diffuse lighting system for the golf ball measuring system.

BACKGROUND OF THE INVENTION

Golf equipment manufacturers currently spend a large amount of time and money on research and development related to better golf clubs and golf balls. Their innovation has led to the development of golf clubs and balls with a wide range of performance characteristics to account for many different types of golfers. Golf clubs may have varying shaft lengths or stiffness. Golf clubs may be manipulated to have different head characteristics, such as loft or lie angle. They may even be manufactured with various combinations of materials in order to attain a specific coefficient of restitution (COR).

Similarly, golf balls have been developed and researched in a similar manner. Golf balls may have solid cores, semi-solid cores, or even fluid cores. They may be manufactured using injection molding processes or they may use a winding process. Even the covers have been manipulated to have a desired number of dimples or dimple arrangements, which aid in increasing or decreasing the lift and drag coefficients of the ball.

The innovations and efforts expended to produce optimal golf equipment, with specifications that meet the requirements set by professional golf associations, are aimed at providing golfers with the best chances of success. However, once a club and ball leave a manufacturer, the performance of the equipment depends largely on the technique and skill of an individual player. Thus, even the most advanced equipment may not be able to correct or fully compensate for flaws in a player's swing.

Many methods and devices have been developed in order to assist players in obtaining an optimal swing. These methods typically consist of acquiring images of a player swinging a golf club and making contact with a golf ball. In a most rudimentary system, photographs of a player's swing, possibly from different angles, may assist a player in correcting their swing. In more advanced systems, a club and ball may be tagged using a set of markers. In combination with a camera system, this can be a powerful tool for analyzing the swing of a player. Typically, the markers placed on the equipment are selected to create a high contrast on the images of the swing captured by the camera. In one example, the markers may be black dots on the surface of a white ball. A strobe fired at the ball during impact captures the black dots on a high contrast white background. The use of black dots, however, may not generate sufficient contrast to allow such a system to be used in an outdoor environment.

As a result, there have been improvements in the types of markers used in more advanced systems that can generate a higher contrast image that is possible with black dots. Two examples of markers in this category are retroreflective markers and fluorescent markers. Retroreflective markers may be manufactured using a variety of materials. These markers may then be placed onto golf equipment. Retroreflective markers are typically used because they return more light to a source than a white diffuse surface. This is because retroreflective markers are designed to reflect a large percentage of concentrated light as a narrow beam back to light source. This is in contrast to a white diffuse surface that reflects light in all directions. Examples of the use of retroreflective markers in monitoring a player's golf swing may be found in U.S. Pat. Nos. 4,158,853, 6,488,591 B1, and 5,471,383, the entireties of which are incorporated herein by reference thereto.

Fluorescent markers are also employed to analyze a player's golf swing. Fluorescent markers may also be manufactured using a variety of materials. However, in contrast to other types of markers, fluorescent markers only reflect light within a range of a desired wavelength. Therefore, when white light hits a fluorescent marker, a portion of the spectrum of the light will excite the fluorescent marker to only return light within a certain wavelength range. Fluorescent markers also return more light to a source than a white diffuse marker filtered at the emission wavelength. Examples of these types of markers, in combination with camera systems and filters, are described in U.S. Patent Application No. 2002/0173367, Gobush et al., the entireties of which are incorporated herein by reference thereto.

Typically, prior camera systems utilized only one type of marker for the objects being monitored. In other words, prior systems typically did not combine different markers. When multiple types of markers have been used, the monitoring systems essentially used two separate camera systems to capture images of the different markers. U.S. Patent Application No. 2002/0155896, for instance, uses two sets of two cameras to capture images of the club and images of the ball. Thus, the monitoring resulted in a complex event scene.

There have been other improvements to swing analysis systems. For instance, prior camera systems that acquire images typically encounter problems with noise and unwanted artifacts. Newer digital cameras typically employ a shutter and a CCD, among other components, to acquire an image. The CCD may be selectively activated and deactivated to acquire an image. This typically reduces the noise and artifacts that are included in an image. However, in many imaging systems that are used to acquire images of a player's swing and/or contact with a golf ball, ambient light can distort the image or captured images and reduce the accuracy and prevents an accurate analysis of a players swing.

A continuing need exists for an apparatus and method for accurately and consistently analyzing a golf players swing and the resulting flight characteristics of a golf ball.

SUMMARY OF THE INVENTION

In an exemplary embodiment, the present invention comprises an apparatus for analyzing the kinematics of golf equipment. The apparatus includes a camera system having a filter. A first and second strobe lamp are also included. The second strobe lamp is preferably configured and adapted to provide a limited wavelength of light. The apparatus also includes a club and a ball, each having one or more selectively positioned markers.

It is preferred that the camera system comprises at least one electronic sensor or chip. In a preferred embodiment, the sensor is a CCD, which is commonly found in digital cameras or the like. Preferably, the camera filter allows light between about 590 and 610 nm to pass to the CCD.

In an exemplary embodiment, the markers positioned on the ball are fluorescent, and the markers placed on the club are retroreflective. It is desired that the strobe lamp is positioned off the camera axis so that in a preferred embodiment it will only illuminate the markers that are positioned on the ball. Preferably, the off axis angle is between about 10 and 20 degrees, and more preferably is between 20 and 30 degrees.

In a preferred embodiment of the present invention, it is not necessary for the camera to be off axis because the camera filter preferably filters out light that reflects off the retroreflective markers. In such an embodiment, there may only be one strobe lamp that is capable of emitting at least a first spectrum of light and a second spectrum of light. Such a strobe lamp my comprise a limited wavelength light source, such as an array of LED's.

In one embodiment, first strobe lamp is filtered to pass light between about 590 and about 610 nm and between about 460 and about 480 nm. Preferably, the second strobe lamp may also be filtered to achieve a limited wavelength of light, between about 590 and about 610 nm. Alternately, the strobe lamp may be a limited wavelength light source, such as an LED.

DETAILED DESCRIPTION OF THE PREFERRED EMBODIMENTS

Figure 1:
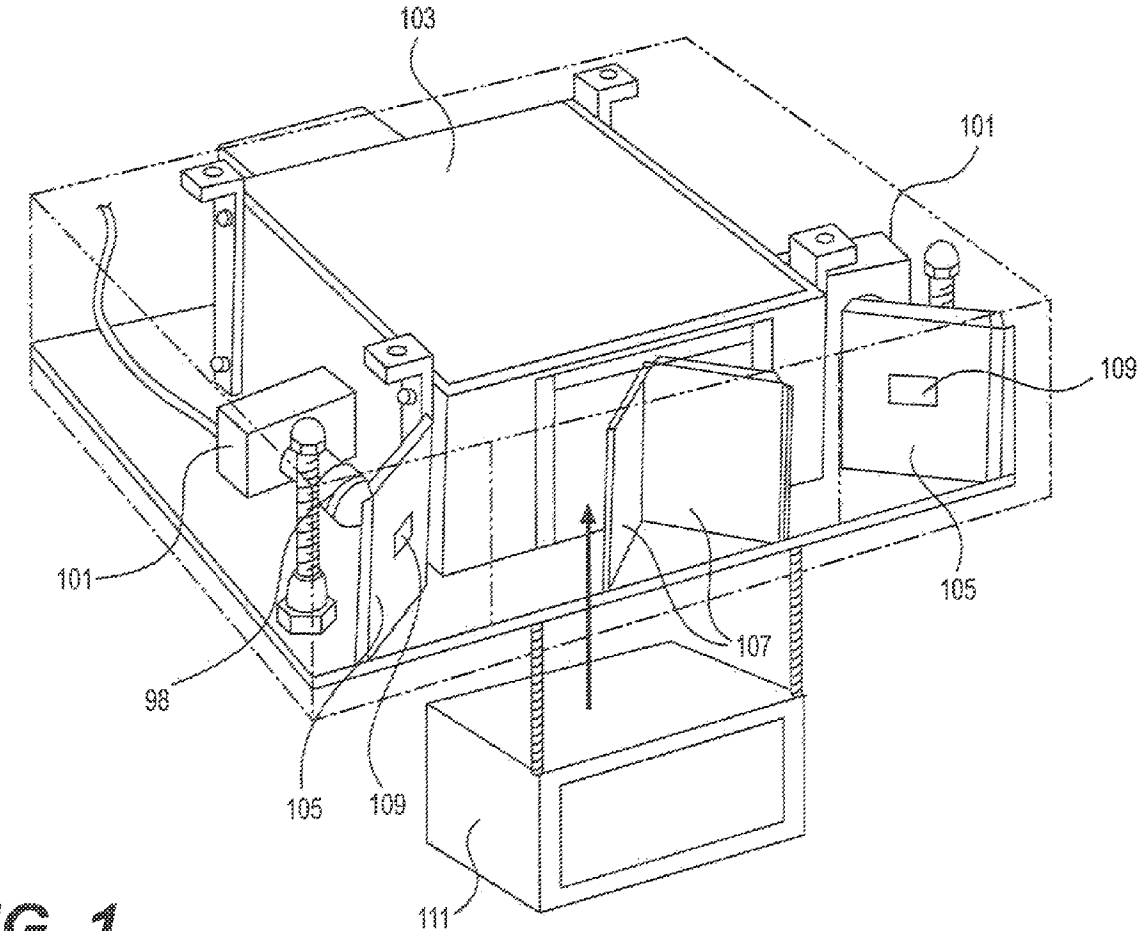
FIG. 1 is a diagram showing an exemplary embodiment of the present invention.

The present invention comprises a camera system that may be used to measure club and ball kinematics. The present invention is capable of capturing images of a club that is in motion, both before and after it strikes a ball. Additionally, the present invention is capable of capturing images of a ball, both before and after it has been struck. By capturing images of the club and ball it is possible to analyze the motion of the club and determine how it may affect the trajectory of a golf ball, and confirm the analysis by analyzing actual ball flight. In a preferred embodiment, the present invention comprises two cameras, at least two mirrors, a beam splitter and at least two filters.

It is desirable when analyzing club motion to capture images of both the club and the ball in order to better determine the orientation of the club relative to the ball. For instance, capturing images of the ball along with the images of the club helps determine how the club is moving through the swing as well as how the club is moving when impacting the ball. Once the ball has been struck, it is desirable to capture only images of the markers on the ball. Since the club image markers would overlap ball image markers in certain instance specifically the second club image overlaps first ball image in ball capture frame.

The present invention uses a combination of different types of markers to distinguish the club from the ball. More preferably the markers are selected so that images of both the club and ball are captured as the club swings towards the ball, but that post impact images primarily capture only the ball markers. Preferably, these images are captured using only one image capturing system. An image capturing system preferably comprises a single camera operating alone, or two cameras operating together. When a single camera is used, it may be desirable to combine the camera system with additional apparatus, such as mirrors, beam splitters, or the like. The additional apparatus preferably allows the single camera to obtain images of a club or ball from at least two different perspectives. Though it may not be necessary, additional apparatus may be used with an image capturing system having two cameras.

It is preferred that one set of markers preferably responds to a limited spectrum of light, while the other set can respond to a wider spectrum. The wider spectrum markers preferably overlap a portion of the limited spectrum markers. This allows both sets of markers to respond to a wide wavelength of light, whereas the narrow spectrum markers may only respond to a narrow wavelength of light. Having the wide spectrum markers overlap a portion of the spectrum of the first marker set allows images of the object having the limited spectrum markers to be isolated by changing the wavelength of light that illuminates each of the objects. Either set of markers may be placed on the club or the ball. However, the limited spectrum markers are preferably placed on the golf ball, while the wide spectrum markers are preferably placed on the golf club. Placing the limited spectrum markers on the golf ball allows post impact images of the golf ball to be captured without interfering images of the golf club. The fluorescent markers may be pad printed on ball for easier marking than retro.

More than two sets of markers may be used. In one example, two or more sets of limited spectrum markers may be used. It is preferred that a portion of at least two of the limited spectrum markers preferably overlap, such that at least two of the markers may be illuminated by a wide spectrum of light. When it is desirable to illuminate only one set of markers, a limited spectrum of light may be used.

One example of the present invention is the use of a combination of retroreflective markers (wide spectrum) and fluorescent markers (limited spectrum). Preferably, at least one retroreflective marker is placed on a golf club in a manner that allows the camera system to identify the club and its orientation at predetermined points on a golf club. Additionally, at least one fluorescent marker is preferably placed on the surface of the golf ball.

In a preferred embodiment, a plurality of retroreflective markers may be placed at different points on the surface of the golf club. The different points may include the shaft, toe, heel, or sole of the club. In an exemplary embodiment, the placement of the retroreflective markers is chosen in order to identify from the images the orientation, clubhead speed, and possibly other characteristics of the swing of the club. The placement of the markers also may be selected in order to measure kinematic characteristics of the club such as loft or lie angle and rotation rate of the club during the swing. Those skilled in the art will recognize that the placement of the retroreflective markers may be varied according to a particular application.

The placement of the fluorescent markers on the surface of the golf ball likewise may be placed in a manner that allows the camera system to identify the ball and its orientation. Similar to the placement of the retroreflective markers on the surface of the golf club, the placement of the fluorescent markers on the surface of the golf ball is chosen in order to identify ball flight characteristics from the captured images. Skilled artisans would recognize that many different marker sizes, configurations, orientation, and position may be used on a ball to measure flight characteristics such as spin, trajectory, and velocity. Some examples of marker placement for a golf ball are described in U.S. Pat. No. 6,390,934 which are incorporated herein in their entireties.

FIG. 1 is a diagram of one embodiment of the present invention. As shown, this embodiment uses a camera system having two cameras 101, first and second strobe lamps 103 and 111, and a beam splitter 107 and a set of mirrors 105 that are capable of directing the light generated by the strobe lamp 103 towards the golf club and ball. Two filters 98 filter the light that reflects off of the golf club and ball before it enters the cameras 101.

The retroreflective and fluorescent markers on both the golf club and the golf ball are responsive to the wide spectrum of light produced by strobe lamp 103. The wide spectrum of light preferably includes the excitation wavelength of the fluorescent markers on the golf ball. In another example, the strobe lamp 103 may produce a wavelength of light that is allowed to pass through filters 98, in addition to the excitation wavelength of the fluorescent markers. In the above examples, desired wavelengths of light may be isolated using any filter known to those skilled in the art. In other examples, a strobe lamp that emits a desired wavelength, i.e., a LED, may be used without a filter.

According to a preferred embodiment of the present invention, the first strobe lamp 103 is capable of generating flashes of light that illuminate the golf club and the golf ball. Preferably, the strobe lamp 103 generates flashes while the club is in motion and the ball is at rest. It is preferred that the strobe produces light that will illuminate both the ball and the club markers. Thus, in one embodiment the spectrum of light produced by the strobe lamp 103 should include light in both the excitation wavelength of the fluorescent marker and light that will pass through the camera filter 98 after illuminating the retroreflective markers.

In a preferred embodiment, the wavelengths that are allowed to pass through the filter depend on the types of filters 98 that are placed in front of the camera and the types of reflectors that are used on the golf club and golf ball. For example, the wavelengths of light that are permitted to pass through the filters are determined by the types of reflectors that are used on the golf club and/or the golf ball. As previously discussed, retroreflective markers and fluorescent markers are placed on the surfaces of the golf clubs and golf ball, respectively. Typically, and as understood by one skilled in the art, retroreflective markers reflect about 1000 percent more light than a white diffuse surface reflects to its source, while fluorescent markers reflect about 200 percent brighter light than a white diffuse markers, irrespective of the light source location. In order for retroreflective markers to reflect the maximum amount of light, the angle between the light source axis and the camera axis should be small. Preferably, this angle is less than 15 degrees. The high intensity of the reflected light from the markers allows the captured image of the markers to have a high contrast in comparison to the background or remainder of the field of view. For instance, the markers used may be selected so that they reflect about 150% or more light than a white diffuse marker reflects. More preferably, the markers may be selected so that they reflect more than 400%, and most preferably the markers may be selected so that they reflect more than 900% of the light that a white diffuse markers reflects to the camera.

In a preferred embodiment, it is desirable for one set of markers to be retroreflective so that they reflect a wide spectrum of light at a high intensity, and for a second set of markers to be fluorescent so that they reflect a narrower spectrum of light at high intensity. For instance, the club may be fitted with one or more retroreflective markers that are capable of reflecting orange light (590-610 nm) at high intensity, while the ball may have orange fluorescent markers that emit orange light at a high intensity when subjected to blue light (460-480 nm). In this manner, both the club markers and ball markers will reflect orange light when subjected to a wide spectrum of light. Since the retroreflective markers have a high reflectance, a lower intensity of orange light from strobe 103 would be necessary to produce a high contrast image. Thus, in a preferred embodiment, it is desirable to permit a small amount of orange light (590-610 nm) to pass through the strobe filter. Additionally, it is desirable to permit a large amount of blue light (460-480 nm) to pass through the strobe filter. By limiting the amount of orange light and maximizing the amount of blue light that is permitted to pass through the strobe filter, images of the golf club and ball may be captured without causing saturation and enhancements of artifacts in the image.

In an exemplary embodiment, the golf ball is stationary during the flashes emitted by the strobe lamp 103. This results in the golf ball reflecting light that is generated by the strobe lamp 103 more than once from the same position. Therefore, the amount of blue light that is allowed to pass through the filter may be adjusted to account for the fact that light will be reflected from the ball more than once.

In a preferred embodiment, the strobe lamp 103 generates a flash of white light, which is then filtered. Preferably, about 30 percent of orange light is permitted to pass through the strobe filter. More preferably, about 20 percent of orange light is permitted to pass through, and most preferably about 10 percent of orange light is permitted to pass through the strobe filter.

In addition to the orange light that is permitted to pass through the strobe filter, about 70 or more percent of light within the blue wavelength (460-480 nm) is preferably permitted to pass through the strobe lamp filter. More preferably, about 80 or more percent of light within the blue wavelength is permitted to pass through, and most preferably 90 percent of light within the blue wavelength is permitted to pass through the strobe filter. Any combination of the percentages of orange and blue light that are permitted to pass through the filter may be used. Though a preferred embodiment of the present invention is described with respect to orange and blue light, those skilled in the art will recognize that any wavelength of light may be used depending on the fluorescent markers and the filters. This includes, but is not limited to, light in the visible and infrared spectrums.

The light that is permitted to pass from the strobe lamp 103, through the strobe filter, is preferably directed towards the golf club and golf ball using at least two sets of mirrors. In a preferred embodiment, the light from the strobe lamp 103 initially hits beam splitting mirrors 107. The light is then deflected towards mirrors 105, which direct the light towards the club and ball. This mirror system creates the on axis camera lighting for retroreflection.

Any type of beam splitters or mirrors known to those skilled in the art may be used. The size, shape, and reflective properties of the mirrors may be chosen according to a particular application. The angles of each of the mirrors are chosen in order to direct the light towards a desired point in front of the apparatus shown in FIG. 1.

As previously described, the first strobe lamp 103 is preferably used to generate images of the club in motion and the ball before impact. In order to generate images of the ball after impact, it is desirable to have a second light source. In a preferred embodiment, the second light source is a second strobe lamp 111. The second strobe lamp 111, as shown in FIG. 1, is preferably placed below the first strobe lamp 103.

The second strobe lamp 111 is preferably activated after the golf club impacts the golf ball. After impact, the first strobe lamp 103 does not generate light. The second strobe lamp 111 may be activated using any desired means. Typically, this may include, but is not limited to, the use of a sound detection device. Such a device would detect the impact of the golf club with the golf ball, and thereby activate the second strobe lamp 111 to generate light. Many methods and apparatus used to detect impact are well known to those skilled in the art, such as in U.S. Pat. No. 6,241,622 BI, which are incorporated in their entirety. Those skilled in the art will recognize that any type of device may be employed to determine impact and activate the strobe lamp 111.

The second strobe lamp 111 preferably only illuminates the fluorescent reflectors on the golf ball. It is preferred that only the excitation wavelength of the fluorescent markers is produced by the second lamp 111. Preferably, the excitation wavelength produced by the second lamp 111 is not allowed to pass through to the camera system. This prevents any light that reflects off of the retroreflective markers from being captured in a post impact image. Preferably, the wavelength of light produced by the second lamp 111 is within a 60 nm range of the excitation wavelength. More preferably, the wavelength is within a 40 nm range, and most preferably the excitation wavelength is within a 20 nm range. Alternately, a limited wavelength of light of light may be produced by the second lamp 111, as long as the limited wavelength excludes the emitted wavelength of the fluorescent markers.

In order to reduce the amount of light produced by strobe lamp 111 that falls on the golf club, the second strobe lamp 111 may be positioned at an angle with respect to the camera axis. As discussed above, a large angle between a light source axis and camera axis reduces their reflective intensity for retroreflection. After the golf club impacts the golf ball, the club will begin to move toward first ball imaged. Typically, in the moments immediately after impact, the first ball will overlap the second club images. Thus, to avoid imaging the club after impact, the second strobe light 111 may be placed on a lower plane than the first strobe lamp 103 and does not create retroreflection.

In an embodiment where the camera is positioned at an angle with respect to the camera axis, the angle between the strobe lamp 111 lighting direction and camera axis may be greater than 10 degrees. Alternately, it may be desirable to make the angle greater than 20 degrees, and most desirably the angle is greater than 30 degrees. The combination of the placement of the strobe lamp 111, and the limited wavelength output, aid in reducing the reflective intensity of the retroreflective markers on the golf club. As discussed with respect to the first strobe lamp 103, the limited wavelength may be produced by using a filter, or a limited wavelength light source such as a LED.

In a preferred embodiment, the second strobe lamp 111 produces blue filtered light (460-480 nm). The blue filtered light is generated in a manner that is similar to the generation of the blue and orange light from strobe lamp 103. However, the second strobe lamp filter preferably only allows blue light to pass. Preferably, the filter allows light within a 50 nm range of the blue wavelength, and more preferably allows light within a 30 nm range to pass.

In order to be able to generate images of the golf ball and golf club, mirrors 105 have an opening that allows a camera to acquire images. The size and shape of the openings may be chosen based a plurality of factors that include, but are not limited to, the size of the camera, the desired area that must be observed, and the size of the objects that must be observed.

In a preferred embodiment, a filter 98 is screw mounted to the camera lens. The filter may be chosen based on many factors. In a preferred embodiment, the filter is orange. The orange filter allows only orange light to pass through to the cameras 101. Preferably, the filters 98 allow less than 5 percent of light that is not orange to pass through. More preferably, the filters allow less than 2 percent, and most preferably the filters allow less than 1 percent of light that is not orange to pass through.

In another embodiment, the strobe lamp 103 may be configured and adapted to provide at least a first spectrum of light and a second spectrum of light. In one embodiment, the first spectrum of light preferably comprises a first and second light source. It is desirable to have the first light source provide light at a first wavelength, and the second light source provide light at a second wavelength. The second spectrum of light preferably comprises only the second light source.

In other embodiments, the first and second wavelengths may be provided by alternate light sources, such as a ring lamp or the like. The light sources that provide the first and second wavelengths do not have to be placed at the same location. For example, a ring lamp may be placed around or on top of the cameras.

The wavelengths of light that are provided may be based on the camera filter 98 and the types of markers that are positioned on the club and the ball. For example, in one embodiment described above, retroreflective markers are placed on the club and fluorescent markers are placed on the ball. The fluorescent markers are excited by blue light and emit orange light in response. The filter 98 placed before the camera only allows orange light to pass. Thus, it would be desirable for the first wavelength of light to be blue, and the second wavelength to be orange. This allows the orange light to reflect off the retroreflective markers and pass through the camera filter 98. In a similar manner, the blue light would cause the fluorescent markers to emit orange light, which would also pass through the camera filter 98.

The strobe lamp may provide the first and second wavelength in any desirable manner. For example, the strobe lamp may comprise two light sources, each having its own filter. In a more preferred embodiment, the strobe lamp may comprise a plurality of limited spectrum light sources, such as LED's or the like. The LED's may be configured and positioned such that they can adequately illuminate the markers that are placed on the club and the ball. Preferably, the LED's can adequately illuminate the markers with light that is sufficiently intense to be imaged by the cameras. It may be desirable to arrange the different LED's in an alternating manner. Alternately, it may be desirable to place one set of LED's on one side of the strobe lamp 103, and the second set on the other side of the strobe lamp 103.

In an embodiment that uses LED's as light sources, it is preferred that the strobe lamp comprises about 100 or more LED's. More preferably, it is desirable to have about 200 or more LED's, and most preferably about 300 or more.

Any type of filter known to those skilled in the art may be used. Though the preferred embodiment is described with respect to an orange filter, it will be recognized that any filter may be used to allow any colors or combinations of colors to pass. The color of the filter, and the amount and type of light that is allowed to pass through may depend on a particular application.

It is preferred that the camera system includes an electronic sensor or chip for capturing images. The electronic sensor or chip records light that falls on it. These types of sensors are typically found in digital cameras. Such a camera system may be used according to the present invention in order to obtain high quality images. The electronic sensor or chip may be selectively activated or deactivated at desired intervals in order to obtain two or more time spaced images.

In a preferred embodiment, the two cameras 101 that are located behind the mirror opening 109 are used to capture images of the golf club and golf ball. Preferably, the cameras

101 are able to take multiple images of the golf ball and/or golf club to analyze the movement of the club and/or ball. This may be accomplished using a variety of methods. Preferably, a multi-frame method may be employed. This method is well known to those skilled in the art, and involves taking multiple images in different frames and then separated by the frames analyzing.

More preferably, a method that uses multiple strobing in a single frame may be used. In one example of such a method, the shutter of the camera is maintained in an open position for a desired period of time. While the shutter is open, the CCD of the camera is maintained in an activated state, so that the camera is able to acquire multiple images on the same frame. This method is analogous to using an analog camera that uses film with low sensitivity and maintains the shutter of the cameras in an open position. Because the shutter is continuously open, multiple images may be acquired onto the same frame by using the strobing light. In the sunlight, this method can create poor images due to sunlight bleaching the strobed images.

Most preferably, a multishutter system is employed. An example of a multishutter system is the Pulnix TM6705AN camera, which is described in U.S. Pat. No. 6,533,674 and incorporated herein by reference. The Pulnix TM6705AN camera is a square pixel, VGA format, black and white full frame shutter camera. The camera features an electronic shutter that allows the camera to take multiple shutter exposures within a frame to capture high speed events. The camera has a small, lightweight, rugged design, making it ideal for portable systems. In a multishutter system, the camera shutters by activating and deactivating the pixel elements of the CCD sensor. The camera also includes a CCD which may be selectively activated. At desired intervals, the CCD of the camera may be activated and deactivated in order to acquire images on the same frame. A multishutter camera allows multiple images to be acquired in one frame while minimizing the amount of background noise present in the frame.

Figure 2:
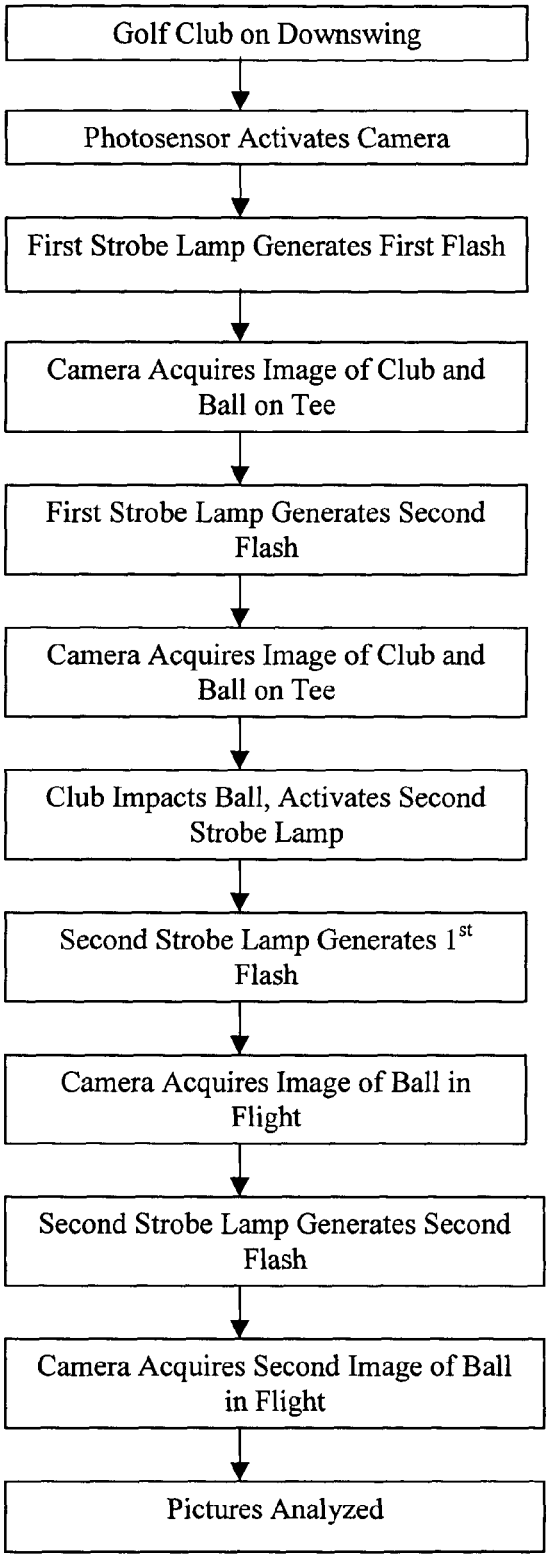
FIG. 2 is flow chart showing steps in an exemplary embodiment of the present invention.

According to the method of the present invention, a golf club and golf ball are imaged using the apparatus described above. Referring to FIG. 2, a golf club and ball may be placed in front of the apparatus shown in FIG. 1. In accordance with the present invention, a golf club may be imaged on the upswing or on the downswing, depending on a particular application. In a preferred embodiment, multiple images of the golf club are captured during the downswing.

The swing speed of a club, and thus the velocity of the ball, may vary based on the skill or experience of a player, or the type of club being used. In order to extract useful information about the club and ball, such as that described above, the time interval between captured images may be varied. Swing speeds may vary between 30 and 130 mph, and ball speeds may vary between 50 and 190 mph. For slower swing and ball speeds, the time interval between two images is preferably between 1 and 3 milliseconds, and more preferably between 1.5 and 2 milliseconds. For faster swing and ball speeds, the time interval between two images is preferably between 500 and 1000 microseconds, and more preferably between 600 and 800 microseconds. In some embodiments, the difference between the swing speed and the ball speed may be large. In such embodiments, the time interval between two images of the club and the time interval between two images of the ball may be different.

The first strobe lamp 103 generates a first flash of light when the club is on its downswing, but before it impacts the ball. The light from the first flash illuminates the golf club and the golf ball. As discussed previously, the light emitted from the strobe lamp 103 preferably has a small amount of orange light and a large amount of blue light.

Figure 3:
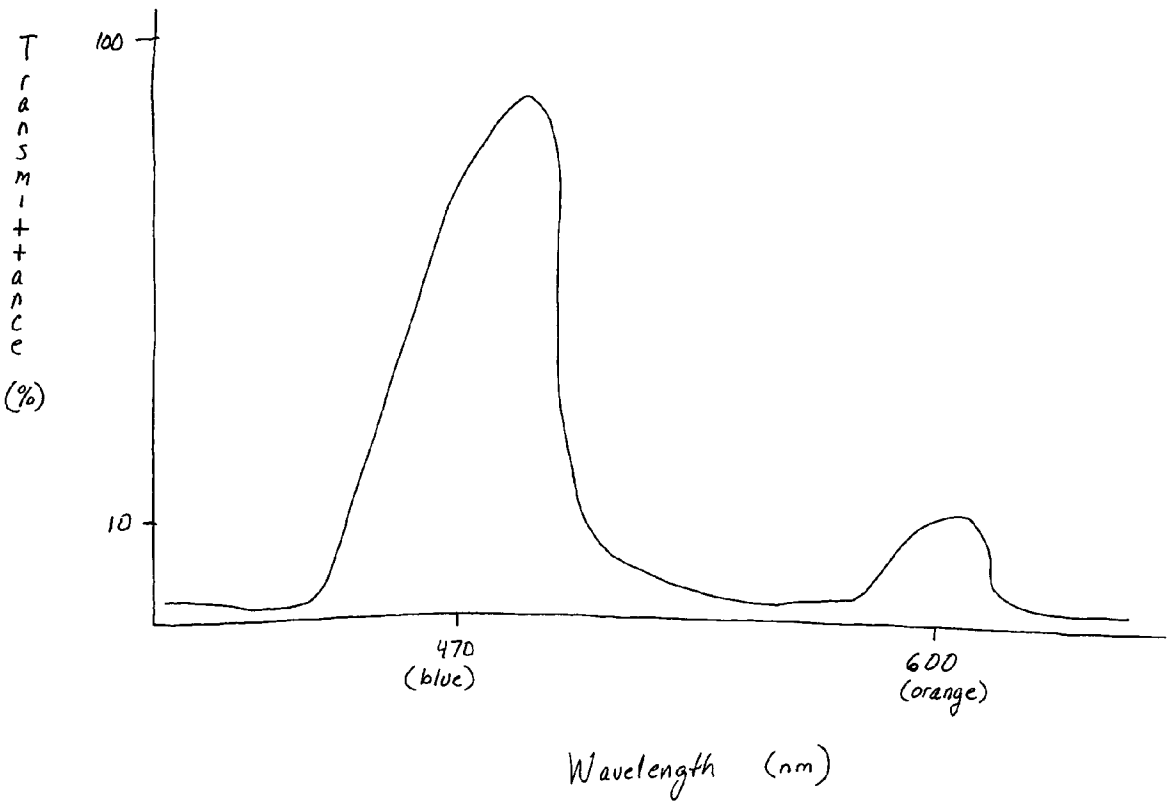
FIG. 3 is a graph showing the wavelengths of light that pass through an exemplary filter in accordance with the present invention.

Referring to FIG. 3, it is desirable to allow a large amount of blue light and a small amount of orange light to pass through the strobe filter. This allows an image of the club and the ball to be acquired. When the small amount of orange light passes through the strobe filter, it will be reflected off of the retroreflective markers, and back to the camera at a high intensity. The large amount of blue light that passes through the strobe filter will excite the fluorescent markers and cause orange light to be emitted back to the camera. This will generate an image of the golf club and the golf ball. By reducing the amount of orange light that is permitted to pass through the strobe filter, the chances of the orange light reflecting off of objects other than the reflectors is significantly reduced. This substantially reduces the chances of noise and unwanted artifacts being acquired by the camera.

When the light from the strobe lamp 103 hits the retroreflective markers that are placed on the club, both the light in the orange and blue wavelengths is reflected back towards the cameras 101. However, because of the orange filter 98, only the orange light is able to pass through to the camera. Once the orange light that is reflected off of the club passes through to the camera, a first image of the club is acquired.

At substantially the same time, the light from the strobe lamp also hits the golf ball, which is stationary. In a preferred embodiment, the fluorescent markers on the surface of the golf ball are excited by blue light, and generate orange light in response. The orange light that is reflected back to the cameras is able to pass through the orange filters 98, and can be imaged by the cameras 101. At this point, the camera has acquired an image of the golf club on its downswing, and the golf ball in a stationary position.

At substantially the same time that the first flash is generated by the strobe lamp 103, the multishutter CCD of the camera 101 is activated in order to acquire the images of the club and ball. The CCD may be activated for any desired period of time. Typically, the activation time is limited in order to avoid streaking or saturation of an image. Preferably, the CCD is activated for 100 microseconds. More preferably, the CCD is activated for 50 microseconds, and most preferably the CCD is activated for 10 microseconds in the multishuttering mode of the camera.

The duration of the first flash may be determined by those skilled in the art. In a preferred embodiment, the duration of the flash is determined based on object speed. In a preferred embodiment, the flash is on at substantially the same time that the CCD is in an activated state. Preferably, the duration of the flash is between 1,000 and 50 microseconds. More preferably the duration of the flash is between 50 and 10 microseconds, and most preferably the duration of the flash is between 10 and 5 microseconds. As will be appreciated by those skilled in the art, the duration of the flash and the CCD activation may be altered according to a particular application.

After the first flash from the strobe light 103, a second flash is generated. The second flash is once again reflected by the golf club and the golf ball, as described above. The duration of the flash and the CCD activation is substantially similar to that described above. However, in other exemplary embodiments, it may be desirable to increase or decrease the duration of the flash and/or CCD activation. Similarly to the first flash, the second flash results in a second image of the golf club. However, the second image of the golf club is further along in the downswing, closer to impact with the golf ball. The golf ball, because it is stationary, reflects the same image back to the cameras 101. Thus, the intensity of the image of the golf ball may appear to be greater than the intensity of the two images of the golf club.

Preferably, the time period between the first and second flashes generated by the strobe light 103 is between 600 microseconds and 2 milliseconds. More preferably, the time period between the flashes is between 800 microseconds and 1200 milliseconds. In alternate embodiments, any combination of the preferred time periods may be employed. Of course those skilled in the art will recognize that the time period between the first and second flashes may be increased, decreased, or altered in any other manner, depending on a particular application.

In other embodiments, the first and second strobe lamps 103 and 111 may each generate only one sustained flash. Each flash is preferably sustained for between 0.03 seconds and 0.0005 seconds, and more preferably for between 0.001 seconds and 0.002 seconds. The sustained flashes preferably illuminate the golf club and golf ball, as described above. However, in this embodiment, two or more time spaced images are obtained by selectively activating and deactivating the electronic sensor or chip of the multishutter camera. The electronic chips may be activated and deactivated at desired intervals according to the speed of the club or ball, as described above.

After impact, the golf club begins its upswing, and the golf ball begins its flight path. Upon contact with the golf ball, the second strobe lamp 111 is activated. It is preferred that the strobe lamp 111 generates light that is around the excitation wavelength of the fluorescent markers, and light that does not include the emission wavelength of the fluorescent marker. The light from the strobe lamp 111 excites the fluorescent marker, which causes the fluorescent marker to produce light that has a desired emission wavelength. Any light that reaches the retroreflective markers of the golf club will be reflected back, however, at a low intensity because of the off axis placement of the lamp 111. Because the light emitted from the strobe lamp 111 does not include the emission wavelength of the fluorescent markers, any light reflected by the retroreflective markers will be filtered out by the camera filters 98.

In a preferred embodiment, the strobe lamp 111 generates only blue light. It is preferable to only acquire images of the golf ball after impact. A preferred embodiment of the present invention achieves such a goal since the blue light from the strobe lamp 111 reaches the golf club, the retroreflective markers on the club will reflect blue light back to the cameras 101. However, because of the orange filters 98, substantially none of this light will reach the cameras 101.

In a preferred embodiment, the second strobe lamp 111 generates two flashes, similarly to the first strobe lamp 103. The first flash from the strobe lamp 111 generates an image of the ball right after impact with the golf club. The blue light from the strobe lamp 111 excites the fluorescent markers on the golf ball, which then return orange light to the cameras 101. The orange light is able to pass completely through the orange filters 98.

In a preferred embodiment, the strobe lamp 111 also generates a second flash. The second flash generates a second image of the golf ball, in flight. The duration between the flashes, and the duration of the activation of the CCD's of the cameras 101 are substantially similar to those described with reference to imaging of the golf club. Those skilled in the art will recognize that the duration of the activation of the CCD and the interval between the flashes may be increased, decreased, and/or altered to suit a particular application.

A preferred embodiment of the present invention is capable of using only two cameras to acquire images that can be analyzed to determine the three dimensional characteristics of a golf club and golf ball. In other embodiments, more than two flashes may be used to acquire images of a golf club and golf ball. The number of images that are desired may depend on the type of analysis that needs to be performed. Of course, the filters that are placed in front of the strobe lamps 103 and 111, and the filters 98 in front of the cameras 101 may be changed to allow different wavelengths of light to pass.

Figure 4:
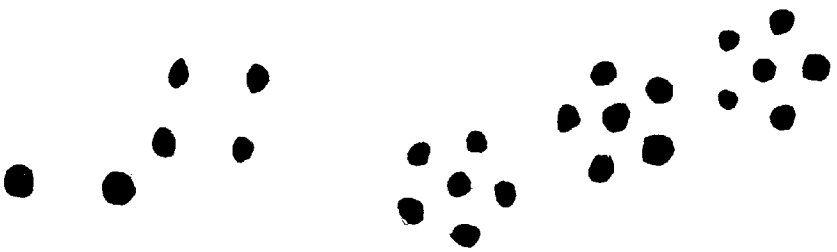
FIG. 4 is a diagram showing an exemplary picture of the club and ball of the present invention.

In a preferred embodiment, the images, shown in FIG. 4, of the golf club and the golf ball may be used to analyze a player's swing and its result on the trajectory of a golf ball. This can be done using any number of methods which are known to those skilled in the art. Because the apparatus according to the present invention is symmetrical, both left and right handed golfers may use the system with substantially little rearrangement of the apparatus.

Although the present invention has been described with reference to particular embodiments, it will be understood to those skilled in the art that the invention is capable of a variety of alternative embodiments within the spirit of the appended claims.

For instance, the apparatus and method of the present invention may be used with a single camera. The camera or cameras may be used to acquire images of contact between any two objects, such as a baseball bat and ball, or a tennis racquet and ball. In other embodiments, the present invention may be used to acquire images of only one object, such as a baseball, football, tennis ball, or the like. The images acquired according to the present invention may be used to analyze any characteristic of a ball in motion, such as flight path, trajectory, distance, or the like. Additionally, two fluorescent markers, each having different excitation wavelengths may be used. The markers may have greater than 72 degree symmetry. For example, the placement of the markers may be altered to provide additional information about the characteristics of the ball in motion.

The invention claimed is:

1. An apparatus for analyzing the kinematics of golf equipment, comprising:

a camera system including a filter;

a first strobe lamp;

a second strobe lamp configured and adapted to provide a limited wavelength of light;

wherein the second strobe lamp is positioned below the first strobe lamp and at an angle of greater than about 10 degrees from the axis of the camera system;

a club having one or more selectively positioned markers; and a ball having one or more selectively positioned markers;

wherein the system is operable to differentiate between the club markers and the ball markers.

2. The apparatus according to claim 1, wherein said camera filter allows light between about 590 and about 610 nm to pass.

3. The apparatus according to claim 1, wherein said second strobe lamp is positioned to provide light off axis from the axis of the camera by between about 10 and about 20 degrees.

4. The apparatus according to claim 1, wherein said markers positioned on said club are retroreflective and said markers positioned on said ball are fluorescent.

5. The apparatus according to claim 1, wherein said second strobe lamp is filtered to achieve a limited wavelength of light.

6. The apparatus according to claim 1, wherein said second strobe lamp is a limited wavelength light source.

7. The apparatus according to claim 6, wherein said limited wavelength light source is an LED.

8. The apparatus according to claim 5, wherein said filter passes light with wavelengths between about 590 and about 610 nm.

9. The apparatus according to claim 1, wherein said first strobe is filtered to pass light between about 590 and about 610 nm and between about 460 and about 480 nm.

10. An apparatus for analyzing the kinematics of golf equipment, comprising:

a camera system including a filter;

a first strobe lamp;

a second strobe lamp;

wherein the second strobe lamp is positioned below the first strobe lamp and off axis from the axis of the camera system by greater than about 10 degrees;

a club having one or more selectively positioned markers;

a ball having one or more selectively positioned markers; and wherein the camera system is configured and positioned to receive light sufficient to image the club and the ball markers when illuminated by the first strobe lamp, and wherein the camera system is configured and positioned to only receive light sufficient to image the ball markers when illuminated by the second strobe lamp.

11. The apparatus according to claim 10, wherein said camera filter allows light between about 590 and about 610 nm to pass.

12. The apparatus according to claim 10, wherein the axis angle of the second strobe lamp provides light on an axis that is off from the axis angle of the camera system by about 10 to about 20 degrees.

13. The apparatus according to claim 10, wherein the axis angle of the second strobe lamp is off from the axis angle of the camera system by about 20 to about 30 degrees.

14. The apparatus according to claim 10, wherein said markers positioned on said club are retroreflective and said markers positioned on said ball are fluorescent.

15. The apparatus according to claim 10, wherein said second strobe is configured and adapted to provide a limited wavelength of light.

16. The apparatus according to claim 10, wherein said first strobe is filtered to pass light between about 590 and about 610 nm and between about 460 and about 480 nm.

17. An apparatus for analyzing the kinematics of golf equipment, comprising:

a camera system including a filter;

a first strobe lamp;

a second strobe lamp;

wherein the second strobe lamp is positioned below the first strobe lamp and off axis from the axis of the camera system by greater than 10 degrees;

a club having one or more selectively positioned retroreflective markers; and a ball having one or more selectively positioned fluorescent markers.

18. The apparatus according to claim 17, wherein said second strobe provides light on an axis that is off axis from an axis of the camera system by about 10 to about 20 degrees.

19. The apparatus according to claim 17, wherein said second strobe is configured and adapted to provide a limited wavelength.

20. The apparatus according to claim 18, wherein said off axis angle is between about 10 to about 20 degrees.

21. The apparatus according to claim 18, wherein said off axis angle is between about 20 to about 30 degrees.

22. The apparatus according to claim 17, wherein said camera system comprises at least one electronic sensor.

23. The apparatus according to claim 22, wherein said electronic sensor is a CCD.

24. An apparatus for analyzing the kinematics of golf equipment, comprising:

a camera system including a filter;

a first strobe lamp configured and adapted to selectively provide at least a first spectrum of light and a second spectrum of light;

a second strobe lamp positioned below the first strobe lamp and off axis from the axis of the camera system by greater than 10 degrees;

a club having one or more selectively positioned markers;

a ball having one or more selectively positioned markers; and wherein the camera system is configured and positioned to receive light sufficient to image the club and the ball markers when illuminated by the first spectrum of light, and wherein the camera system is configured and positioned to only receive light sufficient to image the ball markers when illuminated by the second spectrum of light.

25. The apparatus according to claim 24, wherein the first spectrum of light comprises at least a first and second wavelength of light.

26. The apparatus according to claim 25, wherein the second spectrum of light comprises the second wavelength of light.

27. The apparatus according to claim 24, wherein the first and second spectrum of light are provided by a limited wavelength light source.

28. The apparatus according to claim 27, wherein the limited wavelength light source comprises a plurality of LED's.

29. The apparatus according to claim 28, wherein the plurality of LED's comprises one of:

100 or more LED's;

200 or more LED's; and 300 or more LED's.

* * * * *